US007060010B2

(12) United States Patent
Daniel

(10) Patent No.: US 7,060,010 B2
(45) Date of Patent: Jun. 13, 2006

(54) APPARATUS AND METHOD FOR CONTROLLING LOADING OF WEIGHTS

(75) Inventor: Nir Daniel, Tel-Aviv (IL)

(73) Assignee: Yifat Gurion Ofer, Arsuf (IL)

( * ) Notice: Subject to any disclaimer, the term of this patent is extended or adjusted under 35 U.S.C. 154(b) by 511 days.

(21) Appl. No.: 10/223,217

(22) Filed: Aug. 20, 2002

(65) Prior Publication Data

US 2003/0036465 A1 Feb. 20, 2003

Related U.S. Application Data

(60) Provisional application No. 60/313,666, filed on Aug. 20, 2001.

(51) Int. Cl.
*A63B 21/06* (2006.01)

(52) U.S. Cl. ..... 482/94; 482/1; 482/4; 482/92

(58) Field of Classification Search ..... 482/92–94, 482/98–101, 148, 1–9, 900–902
See application file for complete search history.

(56) References Cited

U.S. PATENT DOCUMENTS

| | | | | |
|---|---|---|---|---|
| 4,746,113 | A | 5/1988 | Kissel | |
| 4,986,538 | A | 1/1991 | Ish, III | |
| 5,037,089 | A | 8/1991 | Spagnuolo et al. | |
| 6,015,367 | A * | 1/2000 | Scaramucci | 482/98 |
| 6,224,519 | B1 | 5/2001 | Doolittle | |

FOREIGN PATENT DOCUMENTS

| | | |
|---|---|---|
| EP | 0 850 667 | 4/1999 |
| EP | 1 125 600 | 8/2001 |
| WO | WO 00/53266 | 9/2000 |

* cited by examiner

*Primary Examiner*—Glenn E. Richman
(74) *Attorney, Agent, or Firm*—Pearl Cohen Zedek Latzer LLP

(57) ABSTRACT

Control means for controlling the activation of exercising loads are disclosed. According an embodiment of the invention the control means comprising at least one linking channel connectable to a control system, and at least one link terminal in active communication with the linking channel, wherein said at least one link terminal is associatable with said exercising load.

2 Claims, 6 Drawing Sheets

APPARATUS AND METHOD FOR CONTROLLING LOADING OF WEIGHTS

CROSS REFERENCES TO OTHER APPLICATIONS

The present application claims the priority of U.S. provisional patent application No. 60/313,666 filed on Aug. 20, 2001.

FIELD OF THE INVENTION

The present invention relates to exercise machines and more particularly to the control of variable selection of the exercising load on such a machine.

BACKGROUND OF THE INVENTION

There are numerous types of exercising apparatus which provide a user with the opportunity to keep fit by exercising various muscles of the body in opposition to a load. These machines take on various forms, each of which is configured to exercise different muscles in different parts of the body. A common feature of such machines is a variable load made up of individual weights the aggregation of any number of which produces the load required by the user.

A typical example of a multiple-exercise machine is described in U.S. Pat. No. 4,986,538 to Ish, which includes a press station at which exercises are performed in opposition to a selected amount of weights. The stack of exercise weights utilized is manually selected by utilizing a pin on the bottommost one of the stack of weights actually used.

In more advanced methods for operating multiple-exercise machines various means are built into the weights, thus freeing the user from the need to stop the training, leave his position and change the operated weight by replacing the position of a weight selection pin.

SUMMARY OF THE INVENTION

The present invention is designed to allow a user to remotely select a load to exercise against. This may be achieved without rising from his exercising position as the device may be remotely activated. Further, the variable load may be secured to prevent accident when the machine is both in and out of use.

There is thus provided, in accordance with an embodiment of the invention, a system and method for communicating with any desired load on an exercise machine, so as to activate or deactivate a load selection device housed therein. The system includes specific communication links, each of the links is in operable communication with a corresponding load in the exercise machine, made to allow for controlling each of the loads separately.

Furthermore, in accordance with a an embodiment of the invention, the system and method further include electrical conduits built into the loads so as to enable electrical connection from one load to its adjacent load, and to disconnect that connection when the loads are separated.

Additionally, there is provided, in accordance with an embodiment of the invention, a method for communicating with weights on an exercise machine, the exercise machine having a plurality of weights in slidable communication with at least one load-bearing member, the method includes the steps of:

determining the exercise weight to be loaded; and communicating the determined weight to be loaded to activate a selection device housed within each of the weights;

thereby to selectively lock at least one of the weights to the at least one load-bearing member.

BRIEF DESCRIPTION OF THE DRAWINGS

The present invention will be understood and appreciated more fully from the following detailed description taken in conjunction with the appended drawings in which.

DETAILED DESCRIPTION OF THE PRESENT INVENTION

Figure 1:
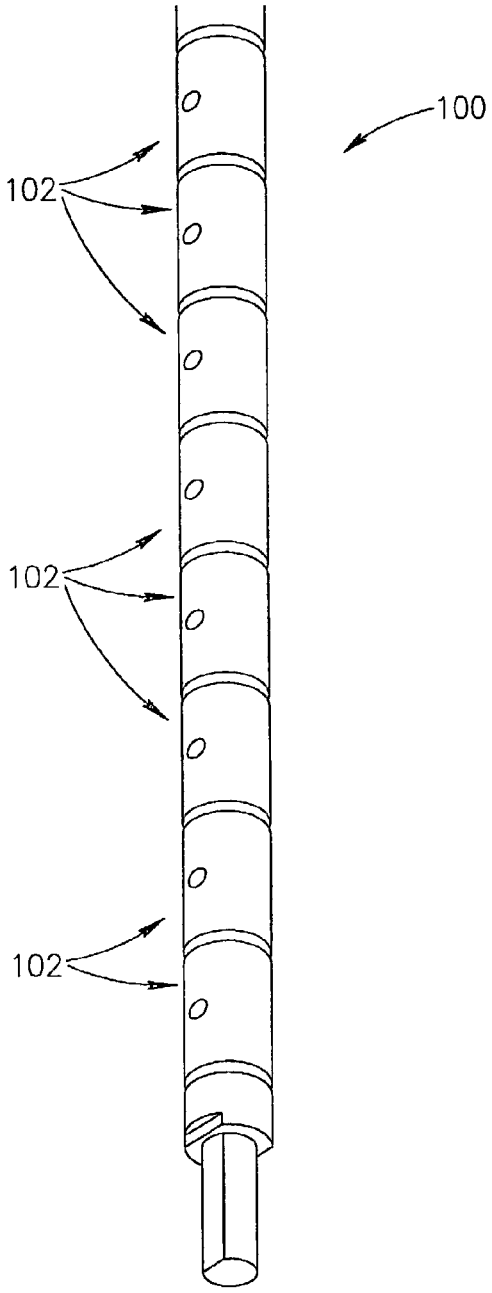
FIG. 1 is an isometric illustration of a multi-contacts rod, constructed and operative in accordance with an embodiment of the present invention.
Figure 1A:
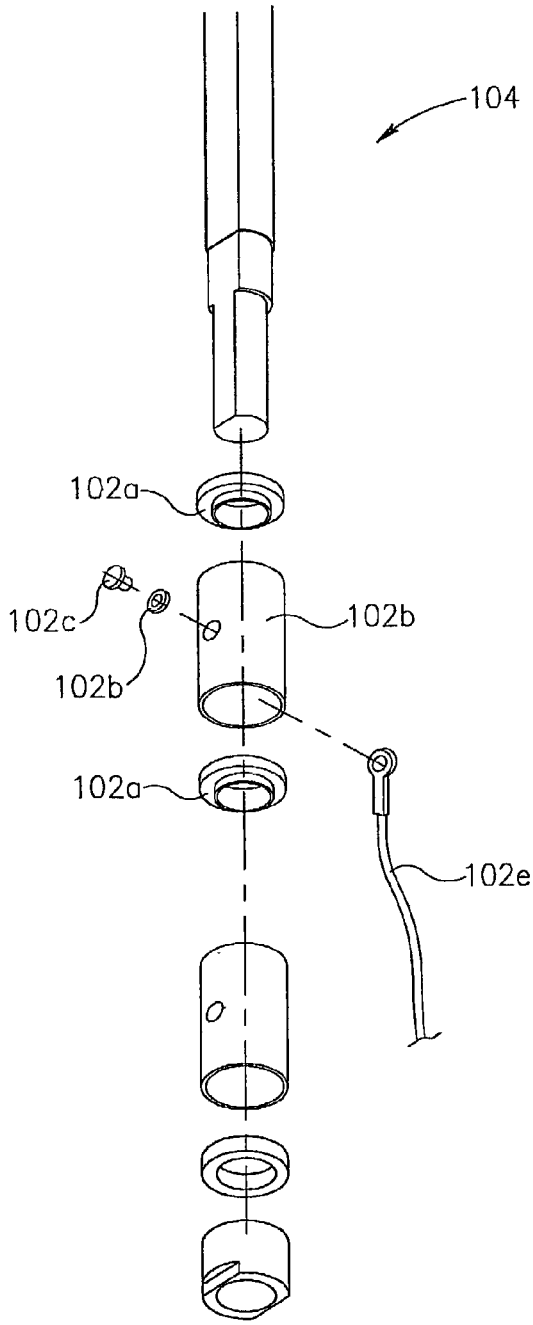
FIG. 1A is an exploded isometric illustration of a multi-contacts rod, constructed and operative in accordance with an embodiment of the present invention.

Reference is now made to FIGS. 1 and 1A which are isometric illustrations of a multi-contact rod assembly generally referenced 100 used for separately providing activation/deactivation control to a desired load in a load stack, and an isometric exploded illustration of a multi-contact rod assembly 100. Multi-contact rod 100 is constructed of internal rod 104 shaped for providing internal space for connection wires, each connected to a corresponding contact tube assembly 102. Each contact tube assembly 102 consists of isolated spacers 102*a*, conducting tube 102*b* built to fit in between a pair of isolated spacers 102*a*, connection conduit 102*e* and conduit fixing assembly 102*c*, 102*d*.

Multi-contact rod assembly 100 is inserted in a suitable cavity along the load stack so that when the load stack is in its rest position, contact tube 102 is in position against an internal spring connection (not shown) in each of the exercising loads. Accordingly, in the rest position of the load stack it is possible to control the selection device in any desired load for activation or deactivation via its respective control conduit 102*e*. When the load stack is in operative position, contact tubes 102 may not be in connection with some or all of the loads.

Figure 2:
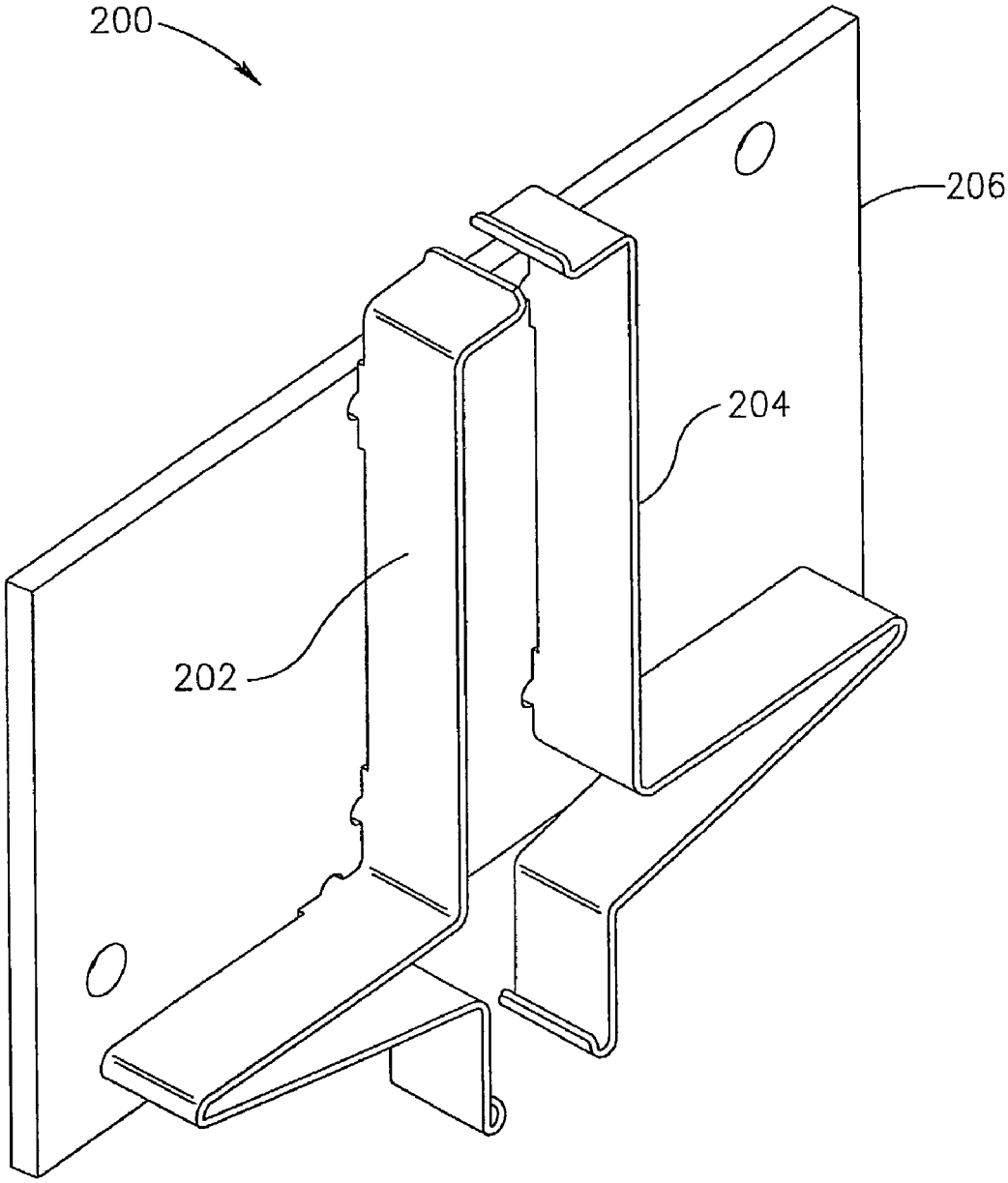
FIG. 2 is an isometric illustration of dual contact sub-assembly installed in a weight, constructed and operative in accordance with an embodiment of the present invention.
Figure 3:
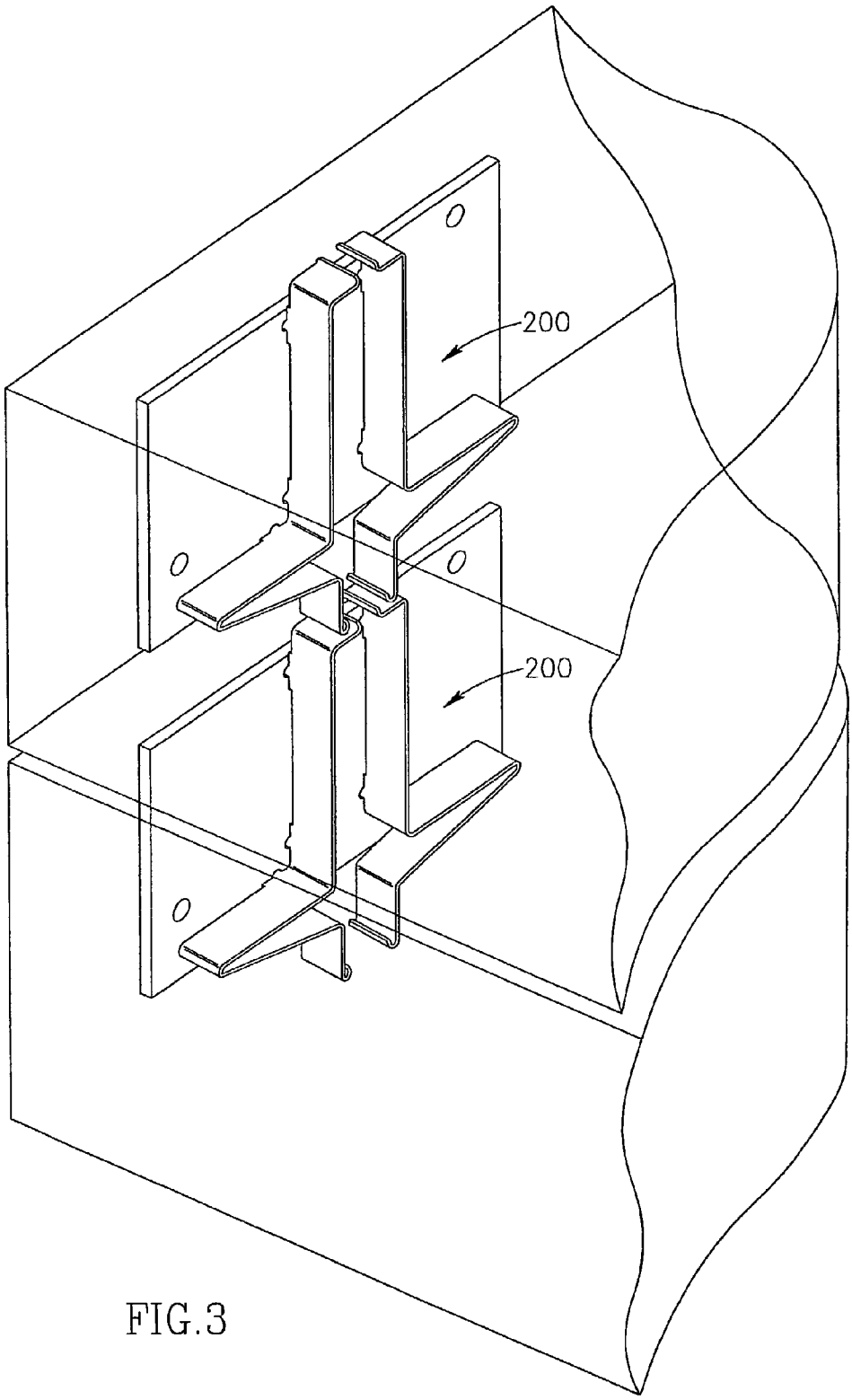
FIG. 3 is an isometric illustration of dual contact assemblies in two adjacent loads, constructed and operative in accordance with an embodiment of the present invention.

Reference is now made to FIGS. 2 and 3, which are isometric illustrations of dual contact sub-assembly generally referenced 200, installed in a load weight. Accordingly, FIG. 3 illustrates more than one contact assembly 200 installed in adjacent loads. Like items in previous figures have like reference numbers and will not be described further.

Spring members 202 and 204 are isolatedly installed onto an isolation plate 206 fixed on the internal face of a load side, so that both ends of each member are slightly protrude out of the load contour. Hence, when loads are stacked on each other, each spring member 202 and 204 is in contact with the corresponding spring member in its adjacent load, thus forming unbroken connection path. When a load is lifted from the load beneath it, the connection is broken.

Dual contact assembly 200 may be used for providing electrical power and/or control to the loads in a safe manner so that when the exercise machine is being used the machine may be disconnected and no power or control may be provided to the loads on the load-bearing bar.

Figure 4:
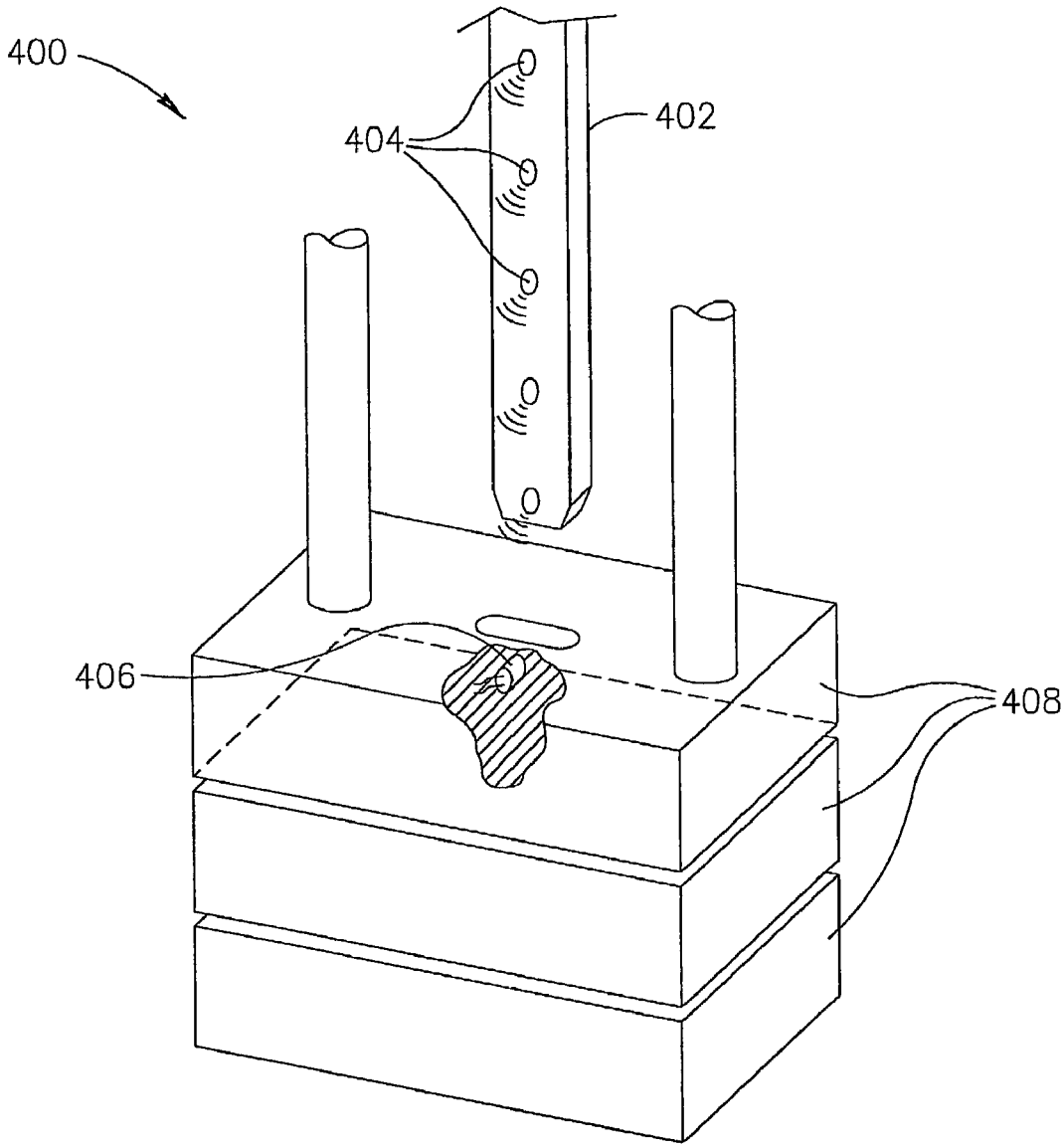
FIG. 4 is an isometric illustration of loads stack with partial cross section showing an internal proximity switch receiver housed in a load, constructed and operative in accordance with an embodiment of the present invention.

Reference is now made to FIG. 4, which is an isometric illustration of loads stack with partial cross section showing an internal proximity switch receiver 406 housed in a load, and a plurality of proximity switch transmitters 404 installed on the load-bearing bar 402, constructed and operative in accordance with the present invention.

Load-bearing bar 402 is slidely insertable into a matching cavity in loads 408 so that when load-bearing 402 is fully inserted therein, proximity transmitters 404 are positioned against proximity receivers 406 in loads 408, thus allowing for establishing of control links. Proximity transmitters 404 are separately connectable via control links to a control unit so to allow activation of a locking device in any desired load.

Figure 5:
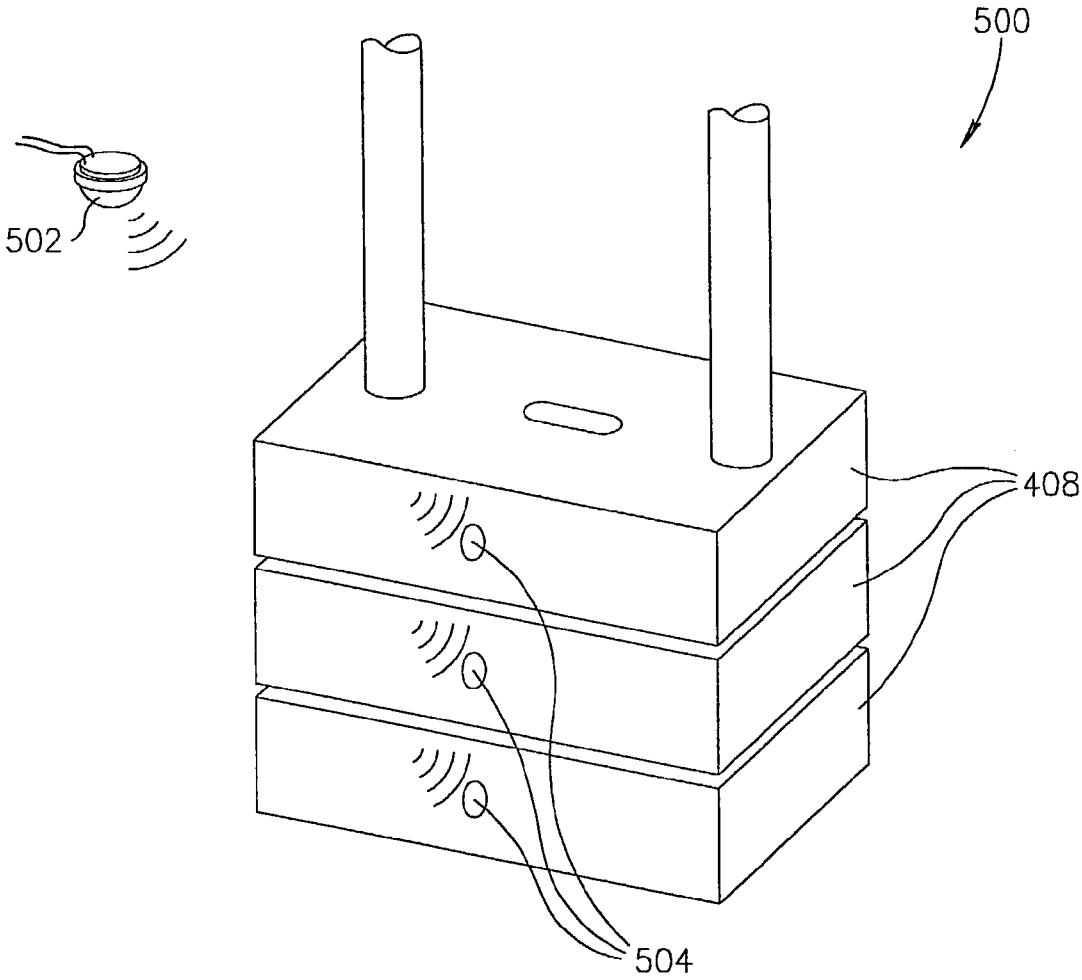
FIG. 5 is an isometric illustration of loads stack, equipped with a remote-control receiver, constructed and operative in accordance with an embodiment of the present invention.

Reference is now made to FIG. 5 which is an isometric illustration of load stack locking control system generally referred as 500, consisting of a remote control transmitter 502 and load stack in which each load 408 is equipped with a remote-control receiver 504, constructed and operative in accordance with a preferred embodiment of the present invention.

In order to lock a desired load 408 to load-bearing bar (not shown) in system 500, remote control transmitter 502 transmits coded signal being decodable only by one load 408 after received by its corresponding remote control receiver 504. Once a locking signal is received and decoded, it activates the corresponding locking device in a desired load.

Figure 6:
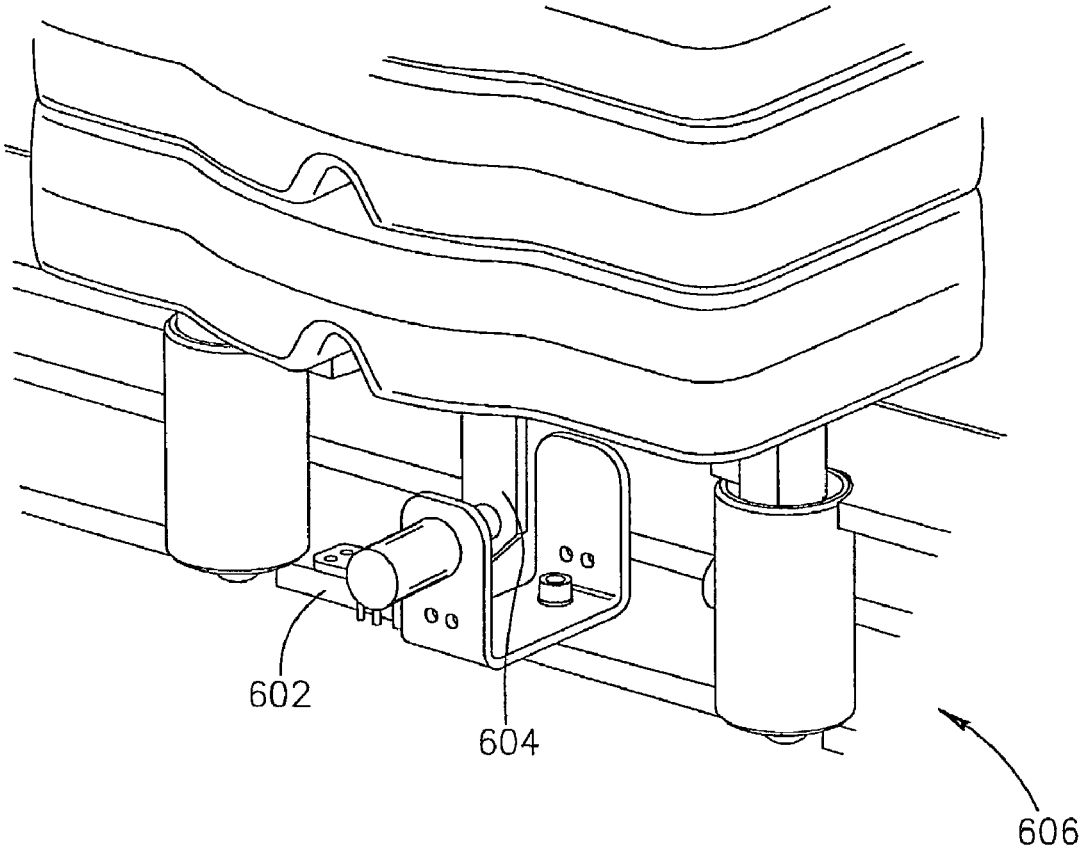
FIG. 6 is an isometric illustration of a proximity switch installed at the base of the load stack, constructed and operative in accordance with an embodiment of the present invention.

FIG. 6 is an isometric illustration of a proximity switch installed at the base of the load stack, constructed and operative in accordance with an embodiment of the present invention. Proximity switch transmitter 602 is installed at the base of load stack 606, so that when the load stack is fully down it is positioned against proximity switch receiver 604. This arrangement may be used to reflect the status of operation of the exercising machine in binary mode, e.g. "in operation" or "out of operation".

Both the arrangement illustrated in FIGS. 2 and 3, and the arrangement illustrated in FIG. 6 may be used for safety means. During routine operation of an exercising machine with load stack it is desired to prevent optional situations, such as activation or deactivation of a locking device when the load stack is not fully down. Control unit that may be connected to the locking devices by means of any of the above described embodiments can take advantage of these arrangements and prevent any undesired or none timed operation of the locking devices, thus enhancing the level of safety of the operation of the exercising machine.

It should be noted that many additional items may be added to the present invention.

It should be noted that the invention is not restricted to a particular type of exercise machine, but the present invention is also applicable to other types of exercise machine capable of carrying the selection system.

It will be appreciated, by persons skilled in the art, that the present invention is not limited by what has been particularly shown and described hereinabove. Rather the scope of the invention is defined by the claims that follow:

What is claimed is:

1. Conducting means for conducting activation control of exercising load comprising:

at least one conducting member installed in said exercising load, wherein said at least one conducting member in a first exercising load is connectable to at least one conducting member in a second exercising load when said first exercising load and said second exercising load are touching;

wherein said at least one conducting member is installed alongside a first side of said exercising load and wherein a first end of said at least one conducting member protrudes out of a second side of said exercising load and a second end of said at least one conducting member protrudes out of a third side of said exercising load.

2. The conducting means of claim 1, wherein said at least one conducting member is a springy member.

* * * * *